US010377049B2

(12) United States Patent
Whittaker et al.

(10) Patent No.: US 10,377,049 B2
(45) Date of Patent: Aug. 13, 2019

(54) COMB ATTACHMENT FOR HAIR CLIPPERS

(71) Applicant: WAHL CLIPPER CORPORATION, Sterling, IL (US)

(72) Inventors: Matthew Whittaker, Sterling, IL (US); Dustin Taylor, Ridott, IL (US); Scott Melton, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 224 days.

(21) Appl. No.: 15/074,837

(22) Filed: Mar. 18, 2016

(65) Prior Publication Data

US 2017/0266823 A1 Sep. 21, 2017

(51) Int. Cl.
*B26B 19/38* (2006.01)
*B26B 19/20* (2006.01)

(52) U.S. Cl.
CPC ..... *B26B 19/3813* (2013.01); *B26B 19/20* (2013.01)

(58) Field of Classification Search
CPC ..... A45D 26/00; B26B 19/06; B26B 19/20; B26B 19/38; B26B 19/3813
See application file for complete search history.

(56) References Cited

U.S. PATENT DOCUMENTS 2,229,688 A * 1/1941 Waldron ..... B26B 19/20 30/201
2,481,097 A * 9/1949 Fewins ..... B26B 19/20 30/200
2,780,868 A * 2/1957 Brown ..... B26B 19/20 30/200
2,918,723 A * 12/1959 Levin ..... B26B 19/20 30/200
3,008,233 A * 11/1961 Waggoner ..... B26B 19/20 30/537
3,041,726 A * 7/1962 Hitson ..... B26B 19/20 30/201
3,149,418 A * 9/1964 Milbourne ..... B26B 19/20 30/201
3,334,416 A * 8/1967 Green ..... B26B 19/20 30/200

(Continued)

FOREIGN PATENT DOCUMENTS

EP 0 925 885 A1 6/1999
EP 0 928 670 A1 7/1999

OTHER PUBLICATIONS

Extended EP search report issued in corresponding EP patent application No. 17161053.8, dated Aug. 23, 2017.

(Continued)

*Primary Examiner* — Jonathan G Riley
(74) *Attorney, Agent, or Firm* — Greer Burns & Crain, Ltd.

(57) ABSTRACT

A comb attachment for a hair clipper includes a base having a depression adjacent a back edge of the attachment and a flexible clip extending outwardly from the back edge. The depression locates a user's finger or thumb when pressing the base until the clip flexes around the edge of the blade. The comb attachment is removed by pulling the clip back around the blade.

The flexible clip can be a cantilever having two spaced arch-shaped arms extending from the base and secured to each other at their cantilevered ends by a cross-member. The bottom surface of the cross-member can be angled to facilitate release of the clip and removal of the attachment.

9 Claims, 6 Drawing Sheets

(56) References Cited

U.S. PATENT DOCUMENTS

| | | | | |
|---|---|---|---|---|
| 3,648,370 | A * | 3/1972 | Cercone | B26B 19/20 30/201 |
| 3,844,036 | A | 10/1974 | Wahl et al. | |
| 3,986,258 | A * | 10/1976 | Liedtke | B26B 21/08 30/30 |
| 5,937,526 | A * | 8/1999 | Wahl | B26B 19/20 30/200 |
| 6,079,103 | A * | 6/2000 | Melton | B26B 19/20 30/43.92 |
| D565,793 | S | 4/2008 | Wallace | |
| D658,331 | S | 4/2012 | Yoon | |
| 8,528,216 | B2 | 9/2013 | Melton et al. | |
| 8,844,142 | B2 * | 9/2014 | Kammer | B26B 19/3846 30/201 |
| D748,862 | S * | 2/2016 | Aulwes | D28/54 |
| 10,011,029 | B2 * | 7/2018 | Bellisario | B26B 19/20 |
| 2004/0250428 | A1 * | 12/2004 | Melton | B26B 19/20 30/200 |
| 2004/0250429 | A1 * | 12/2004 | McCambridge | B26B 19/20 30/233.5 |
| 2008/0005908 | A1 * | 1/2008 | Melton | A45D 24/36 30/233.5 |
| 2008/0072437 | A1 | 3/2008 | Michel | |
| 2008/0184565 | A1 * | 8/2008 | Zoot | B26B 19/22 30/196 |
| 2014/0215832 | A1 * | 8/2014 | Julemont | B26B 19/20 30/200 |
| 2014/0352158 | A1 * | 12/2014 | McCambridge | B26B 19/06 30/200 |
| 2015/0250141 | A1 * | 9/2015 | Ferrentino | A47L 9/06 119/610 |
| 2017/0217031 | A1 * | 8/2017 | Bellisario | B26B 19/20 |

OTHER PUBLICATIONS

EP Office Action issued in corresponding European App. No. 17 161 053.8, dated Jul. 10, 2018.

* cited by examiner

COMB ATTACHMENT FOR HAIR CLIPPERS

This invention relates to comb attachments for hair clippers, including hair trimmers, and more particularly, to hair clipper comb attachments that are removable.

BACKGROUND OF THE INVENTION

Removable hair clipper attachments are common in the hair clipper field. The comb attachments have comb teeth that space the cutting blade on the hair clipper a desired distance from scalp or skin of the user.

Comb attachments are available in a variety of sizes, and are often sold in a kit with a hair clipper. Conventional comb attachments are secured to the stationary blade of the hair clipper by side walls on the outermost teeth on both sides of the comb attachment that guide the attachment along the sides of the stationary cutting blade, grooves that secure the front of the comb attachment to the cutting edge of the stationary blade, and a flexible clip that snaps over the back of the stationary blade to secure the comb attachment in place. In some cases, though, finger pressure on the attachment is misplaced, making attachment awkward. Thus, there is a need for comb attachments for hair clippers that guide the thumb or finger to an appropriate pressure point for installation.

Accordingly, one object of the present invention is to provide new and improved comb attachments for hair clippers.

Another object is to provide new and improved comb attachments for hair clippers that facilitate the application of pressure at an appropriate location in the attachment when securing the attachment to the stationary blade of a hair clipper.

SUMMARY OF THE INVENTION

In keeping with one aspect of this invention, a comb attachment for a hair clipper blade has a base having a front edge, a back edge parallel to and opposite the front edge, a first side edge transverse to the front and back edges and extending from one end of the front edge to one end of the back edge, and a second side edge parallel to the first side edge, extending from the opposite end of the front edge to the opposite end of the back edge.

A plurality of spaced comb teeth extend away from the front edge of the base. A first side wall extends from a first outermost comb tooth along the first side edge, and a second side wall extends from a second outermost comb tooth along the second side edge. Grooves in the outermost comb teeth engage the cutting edge of the stationary hair clipper blade.

The base has a flexible cantilevered attachment clip extending out from the back edge of the base, and a depression in the base itself, adjacent the back edge. The comb attachment is secured to the stationary hair clipper blade by sliding the side walls over side edges of the hair clipper blade until the stationary blade engages the grooves, and pressing the depression until the clip goes around and over the back edge of the hair clipper blade. The comb attachment is removed by releasing the clip from the blade and disengaging the grooves from the blade.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
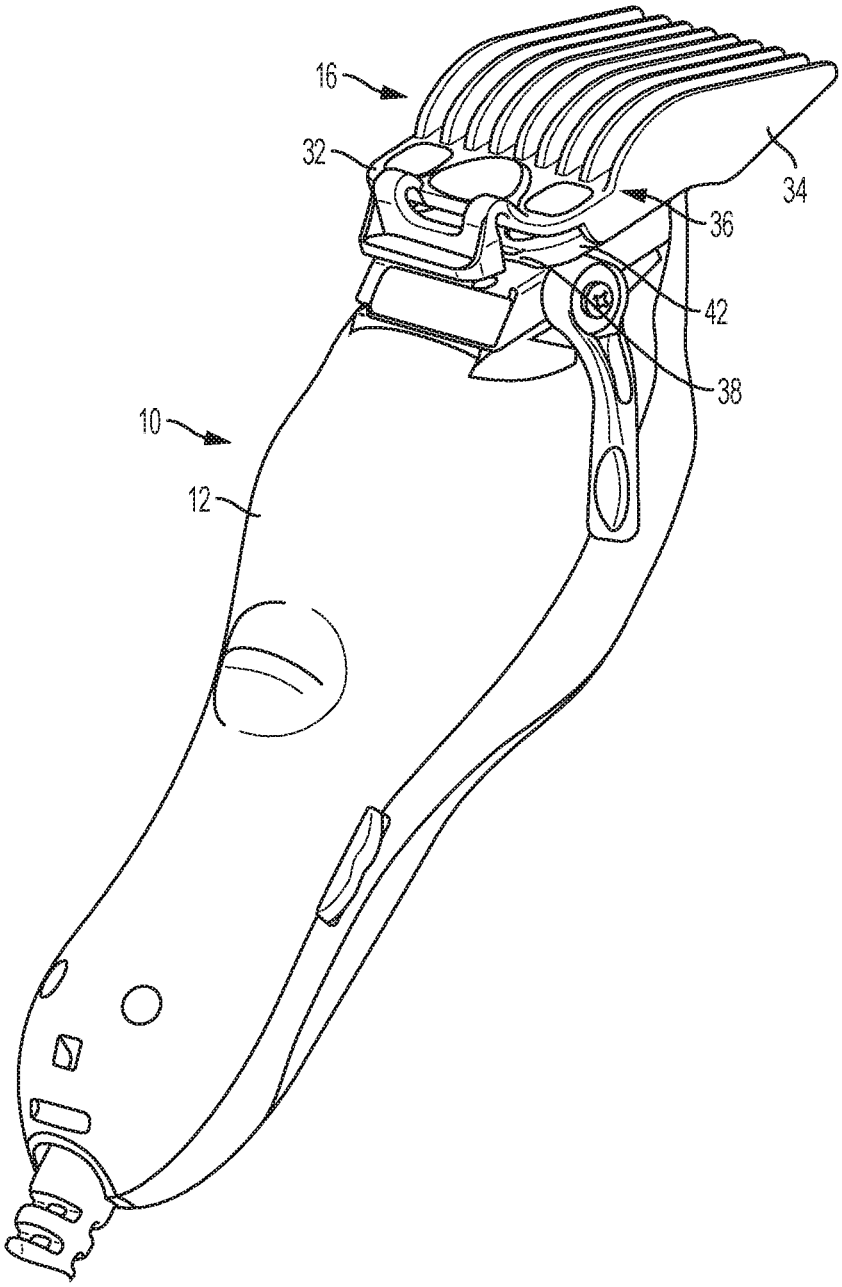
FIG. 1 is a perspective view of a comb attachment attached to a hair clipper.
Figure 2:
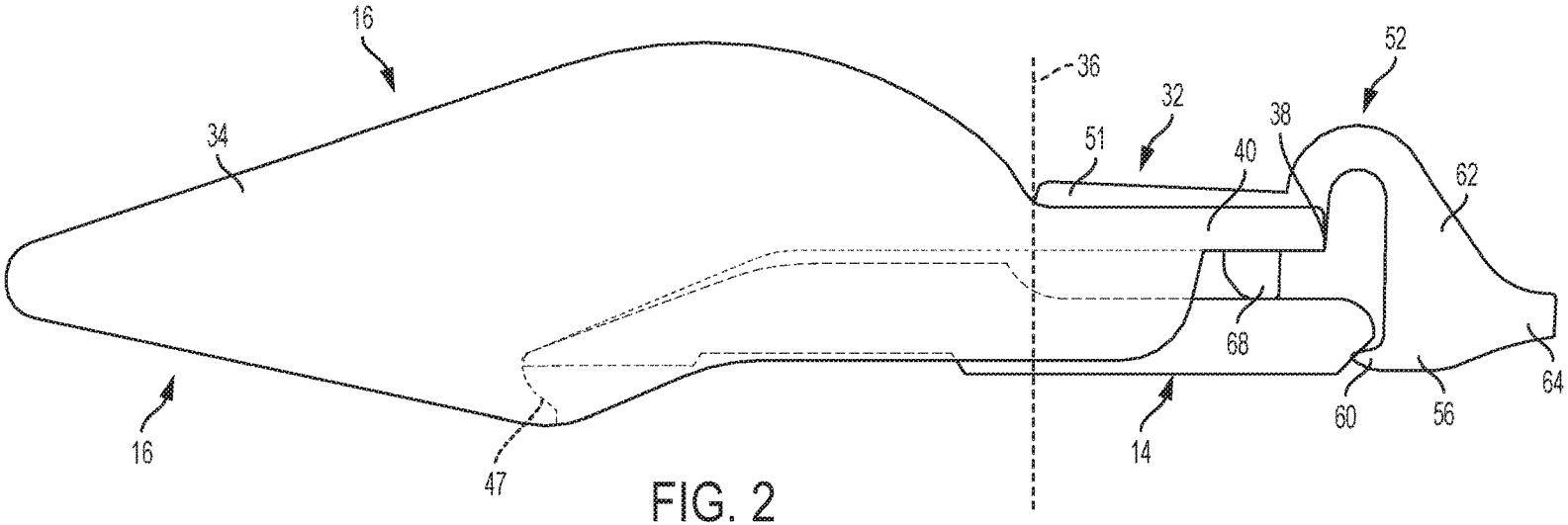
FIG. 2 is a side view showing the comb attachment of FIG. 1 attached to the stationary blade of the hair clipper.

As seen in FIGS. 1 and 2, a hair clipper 10 has a body 12, a stationary blade 14 and a comb attachment 16. The hair clipper 10 also has a reciprocating blade (not shown) that cuts hair that enters complementary cutting teeth on the stationary blade 14 and the reciprocating blade.

The stationary blade 14 has a side edge 18, a second side edge (not shown), blade teeth (not shown) along a front edge 22, and a back edge 24. The comb attachment 16 is removably secured to the stationary blade 14.

The comb attachment 16 has a base 32 and teeth 34 extending outwardly from a front edge 36. The base 32 also has a back edge 38 opposite the front edge 36, a first side edge 40 (FIG. 2) transverse to the front and back edges 36, 38, and a second side edge 42 (FIG. 1) that is also transverse to the edges 36, 38, and is opposite the first side edge 40.

Figure 3:
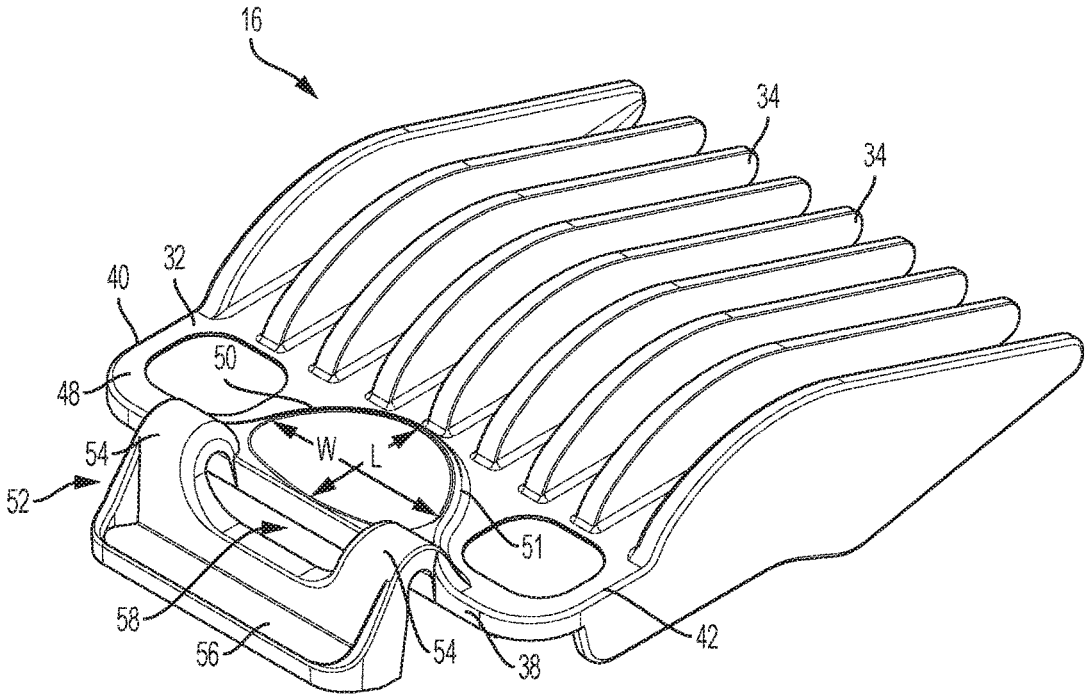
FIG. 3 is a perspective view of the comb attachment of FIG. 1.
Figure 4:
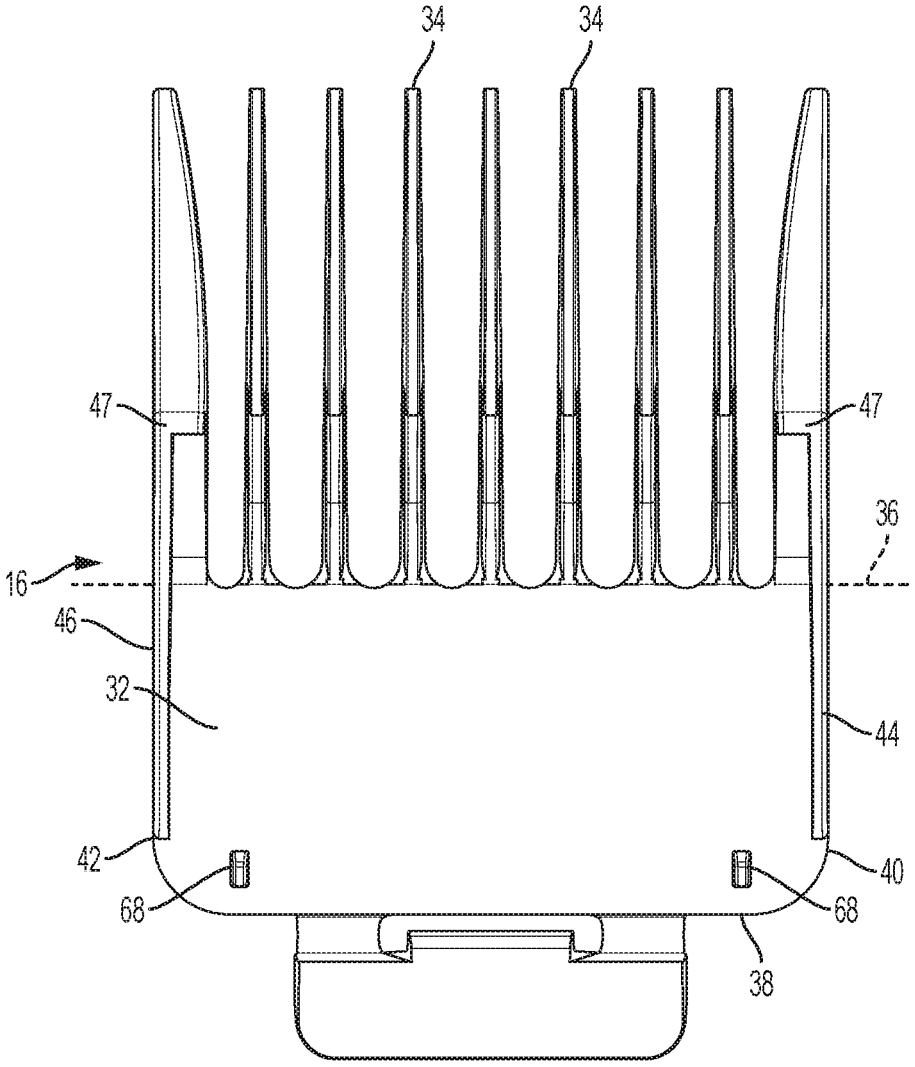
FIG. 4 is a bottom view of the comb attachment of FIG. 1.

The comb teeth 34 are spaced from the edge 40 to the edge 42, as seen in FIGS. 3 and 4. A sidewall 44 extends along the edge 40, and another sidewall 46 extends along the edge 42, as seen in FIG. 4. The sidewalls 44, 46 bracket the blade 14 when the attachment 16 is secured to the blade 14. Two grooves 47 (FIGS. 2, 4 and 6) are provided in the outermost teeth adjacent the side walls 44, 46 to secure the comb attachment 16 to the tips of the blade 14.

A top surface 48 of the base 32 has a depression 50 in or near the center of the base as measured between the edges 40 and 42, as seen in FIG. 3. The depression 50 is adjacent the back edge 38. A ridge 51 generally surrounds the depression 50. A typical depth D of the depression 50 is 0.075", with about a 0.71" width W and a 0.44" length L. The dimensions preferably accommodate the shape of the tip of a user's thumb.

Figure 5:
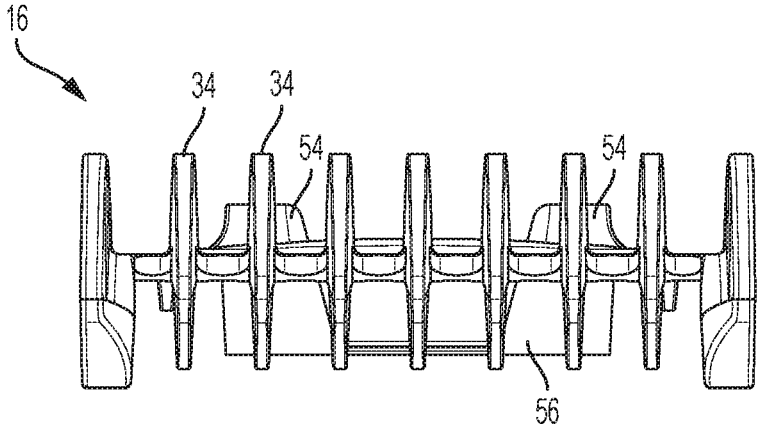
FIG. 5 is a front view of the comb attachment of FIG. 1.
Figure 6:
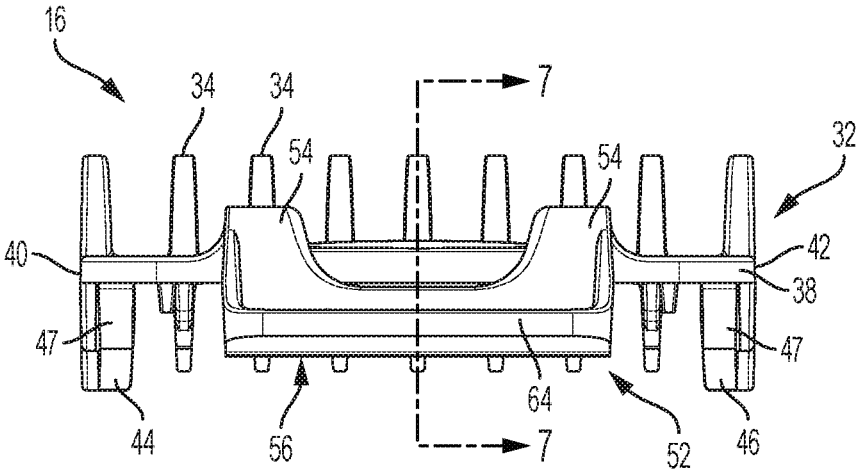
FIG. 6 is a rear view of the comb attachment of FIG. 1.

Referring now to FIGS. 4, 5 and 6, The comb attachment 16 also has a cantilevered flexible clip 52 extending outwardly from the back edge 38 of the base 32, opposite the depression 50. A pair of spaced arch-shaped arms 54 are secured at one end of the clip 52 at the back edge 38. The arch-shape of the arms 54 reduces stress and permanent deformation of the clip 52.

The arms 54 are secured to each other at another end by a cross-member 56, leaving an opening 58 (FIG. 3), including the space between the arms 54, and between the base edge 38 and the cross-member 56. The opening 58 allows the user's thumb or finger to press the depression 50 without interference.

Figure 7:
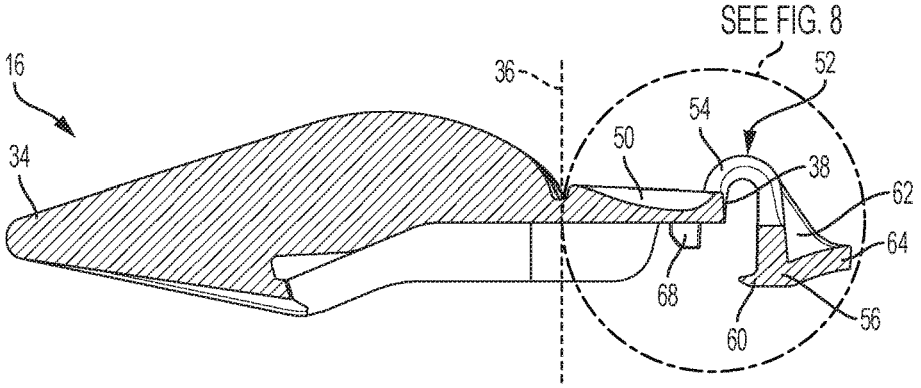
FIG. 7 is a sectional view of the comb attachment of FIG. 1, taken along lines 7-7 in FIG. 6.

The cross-member 56 has a projection 60 (FIGS. 7 and 8) adjacent and spaced downwardly from the edge 38 that secures the comb attachment to the bottom of the hair clipper blade, as seen in FIG. 2. The arch-shape of the arms 54, which provide the space 58 between the projection 60 and the depression 50, allows free movement of the projection 60 and engagement of the projection 60 on the blade 14.

The cross-member 56 also has reinforcing side members 62 (FIGS. 7 and 8) and a lip 64. The lip 64 is on a side of the cross-member 56 that is opposite to the projection 60 side of the cross-member 56.

Figure 8:
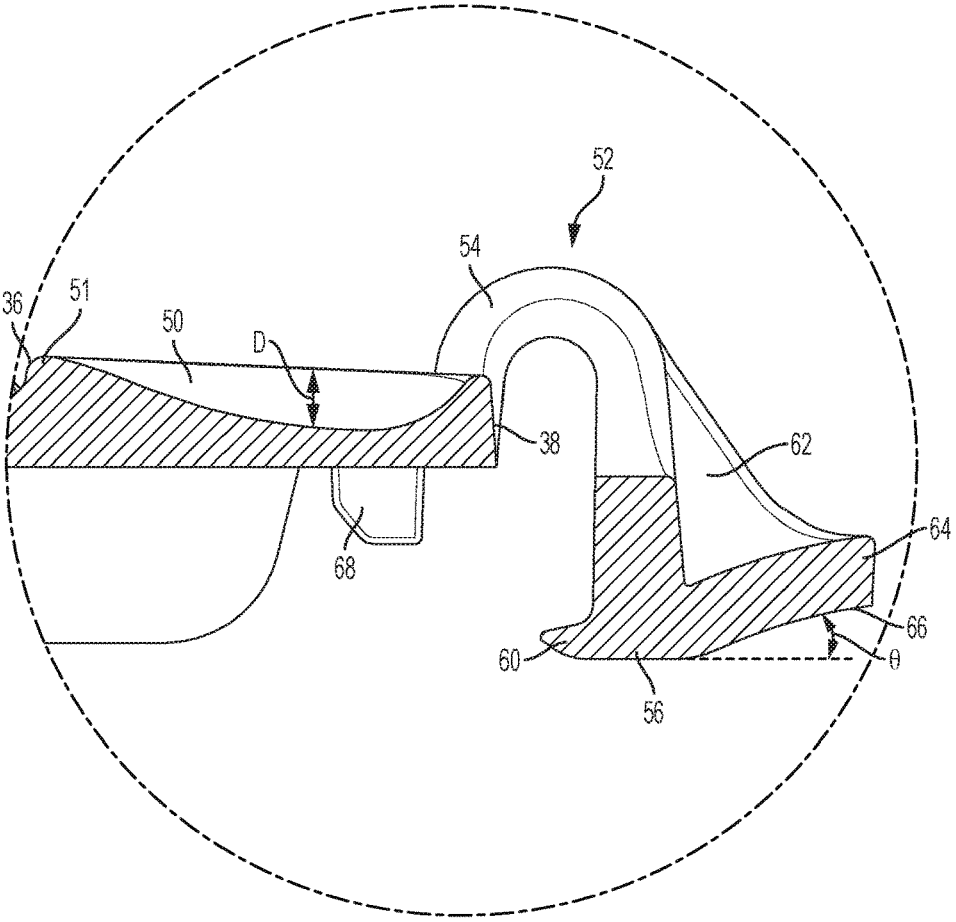
FIG. 8 is an expanded view of a portion of the comb attachment of FIG. 2, showing the detail of B in FIG. 7.

The lip 64 has a bottom surface 66 that is slightly arced and is angled with respect to a line formed by the bottom surface of the stationary blade by an angle θ, as seen in FIG. 8. An angle of about 15 degrees is suitable. The angle θ facilitates removal of the comb attachment from the blade.

The bottom surface of the base has a pair of spaced bumps 68 that secure the comb attachment to the blade in conjunction with the projection 60. The attachment 52 is flexible, though, so that the comb attachment can be easily installed and removed. The comb 16 is attached by sliding the sidewalls 44, 46 over the sides of the stationary blade until the grooves 47 engage, and pressing the depression 50 against the blade until the projection 60 clips over the blade. The comb 16 is removed by pulling the lip 64 away from the blade until the projection 60 is released, and sliding the comb attachment off of the blade.

While the principles of the invention have been described above in connection with specific apparatus and applications, it is to be understood that this description is made only by way of example and not as a limitation on the scope of the invention.

What is claimed is:

1. A comb attachment for a hair clipper blade comprising:

a base having a front edge, a back edge opposite the front edge, the back edge defining a width direction, a first side edge transverse to the front and back edges and extending from one end of the front edge to one end of the back edge, and a second side edge parallel to the first side edge extending from an opposite end of the front edge to an opposite end of the back edge;

a plurality of spaced comb teeth extending from the front edge of the base; and at least one groove adjacent the front edge of the base;

the base further having a depression adjacent to and inside the back edge and a flexible clip extending outwardly from the back edge of the base, the comb attachment being removably secured to the hair clipper blade by sliding the at least one groove over a front cutting edge of the blade and pressing the depression until the flexible clip flexes over and around a back edge of the hair clipper blade, wherein the flexible clip is a flexible bifurcated cantilever extending from the back edge of the base; and the flexible bifurcated cantilever has flexible first and second spaced arms secured at one end at the back edge of the base, a space between the first and second spaced arms being greater than a width of one of the first and second spaced arms in the width direction, the first and second arms extending transverse to the width direction, and being secured to each other at the other end by a cross-member, the cross-member having a projection on a first side facing and spaced from the back edge of the base, the projection securing the comb attachment to the hair clipper blade.

2. The comb attachment of claim 1, wherein the cross-member has a lip on a second side opposite to the first side.

3. The comb attachment of claim 2, wherein the lip has a bottom surface angled with respect to a plane formed by the hair clipper blade.

4. The comb attachment of claim 1, comprising a ridge at least partially surrounding the depression.

5. The comb attachment of claim 1, wherein the at least one groove is a first groove and a second groove; a first sidewall extending from a first outermost comb tooth along the first side edge of the base to the first groove in the first outermost comb tooth, and the second sidewall extending from a second outermost comb tooth along the second side edge to the second groove in the second outermost comb tooth.

6. The comb attachment of claim 1, further comprising: at least one bump extending from a bottom surface of the base adjacent the first and second sidewalls.

7. A comb attachment for a hair clipper blade comprising:

a base having a front edge, a back edge opposite the front edge, the back edge defining a width direction, a first side edge transverse to the front and back edges and extending from one end of the front edge to one end of the back edge, and a second side edge parallel to the first side edge extending from an opposite end of the front edge to an opposite end of the back edge;

a plurality of spaced comb teeth extending from the front edge of the base; and at least one groove adjacent the front edge of the base;

the base further having a flexible clip extending outwardly from the back edge of the base, the comb attachment being removably secured to the hair clipper blade by sliding the at least one groove over a front cutting edge of the blade and pressing the base until the flexible clip flexes over and around a back edge of the hair clipper blade, wherein the flexible clip is a flexible bifurcated cantilever extending from the back edge of the base; and the flexible bifurcated cantilever has separated first and second spaced arms secured at one end at the back edge of the base, a space between the first and second spaced arms being greater than a width of one of the first and second spaced arms in the width direction, the first and second arms extending transverse to the width direction, and being secured to each other at the other end by a cross-member, the cross-member having a projection on a first side facing and spaced from the back edge of the base, the projection securing the comb attachment to the hair clipper blade.

8. The comb attachment of claim 7, wherein the cross-member has a lip on a second side opposite to the first side.

9. The comb attachment of claim 8, wherein the lip has a bottom surface angled with respect to a plane formed by the hair clipper blade.

* * * * *